US005183431A

United States Patent [19]

Todokoro

[11] Patent Number: 5,183,431

[45] Date of Patent: Feb. 2, 1993

[54] TOY FACSIMILE MACHINE

[75] Inventor: Masatoshi Todokoro, Matsudo, Japan

[73] Assignee: Staff Co., Ltd., Tokyo, Japan

[21] Appl. No.: 697,636

[22] Filed: May 8, 1991

[30] Foreign Application Priority Data

Jun. 5, 1990 [JP] Japan ..... 2-5885

[51] Int. Cl.[5] ..... A63H 33/30; A63H 29/22; H04M 11/00

[52] U.S. Cl. ..... 446/142; 446/475; 446/484; 358/400; D 21/111; D 14/118; 379/100

[58] Field of Search ..... D 21/111; D 14/118; 379/100; 358/400, 476, 497; 446/141, 142, 143, 144, 475, 483, 484, 485, 489, 490, 491

[56] References Cited

U.S. PATENT DOCUMENTS

| | | | |
|---|---|---|---|
| D. 266,682 | 10/1982 | Airlie | D 21/111 X |
| D. 282,763 | 2/1986 | Catelli | D 21/111 |
| D. 314,957 | 2/1991 | Tsukada | D 14/118 |
| D. 316,712 | 5/1991 | Tsukada | D 14/118 |
| D. 323,495 | 1/1992 | Mizuno et al. | D 14/118 |
| D. 324,086 | 2/1992 | Woo | D 21/111 |
| 4,667,252 | 5/1987 | Nakamura et al. | 379/100 X |
| 4,827,085 | 5/1989 | Yaniv et al. | 379/100 X |
| 4,914,281 | 4/1990 | Benton et al. | D 14/118 X |
| 4,962,526 | 10/1990 | Kotani et al. | 379/100 |
| 5,072,307 | 12/1991 | Shirakoshi et al. | 358/400 |

*Primary Examiner*—D. Neal Muir

*Attorney, Agent, or Firm*—Joseph C. Mason, Jr.; Ronald E. Smith

[57] ABSTRACT

A toy facsimile machine has a hollow case for housing a rotatably mounted roll of paper, transfer roll members that frictionally engage the paper to unroll it, a plate positioned between the roll and the transfer roll members to support the unrolled paper so that the user of the toy may write and draw on the paper, a motor for activating the transfer roll members, an integrated circuit for generating tone signals, a speaker for converting those signals into sound, and a battery for operating the motor and integrated circuit. A window frame formed in the case exposes the paper so that the user may write and draw on it. A delivery port is formed in a leading end of the toy and operation of the transfer roll members feeds the paper out of the hollow interior of the toy through that port. A cutting device is positioned at the port so that the discharged paper may be cut off by pulling up on it. Further features include a model telephone head set cradled by the case and a manually operated rotatably mounted spool for taking slack out of the roll of paper.

15 Claims, 6 Drawing Sheets

TOY FACSIMILE MACHINE

BACKGROUND OF THE INVENTION

1. Field of the Invention

The present invention relates to a toy which makes it possible to enjoy playing at the operation of a facsimile apparatus.

2. Description of the Prior Art

Toys which are so constructed as to make it possible to enjoy playing at the operation of facsimile apparatuses have not been seen heretofore.

SUMMARY OF THE INVENTION

An object of the present invention is to furnish an interesting toy facsimile which provides such effects as enabling children to enjoy playing at the operation of a facsimile apparatus and to learn the function and usage of an actual facsimile apparatus through such playing.

The above-stated object and features of the present invention will be understood particularly by taking the following description into consideration in reference to attached drawings which illustrate an embodiment thereof.

BRIEF DESCRIPTION OF THE DRAWINGS

The drawings illustrate an embodiment of the present device, of which

DETAILED DESCRIPTION OF THE PREFERRED EMBODIMENTS

Figure 3:
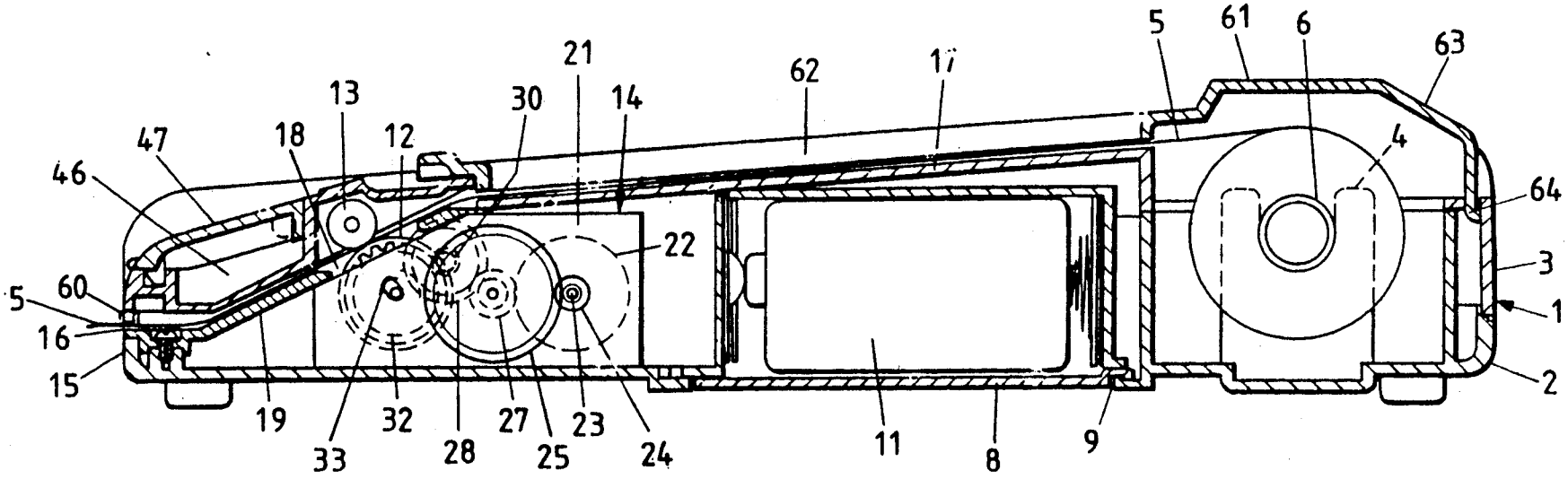
FIG. 3 is an enlarged view of a central section.
Figure 4:
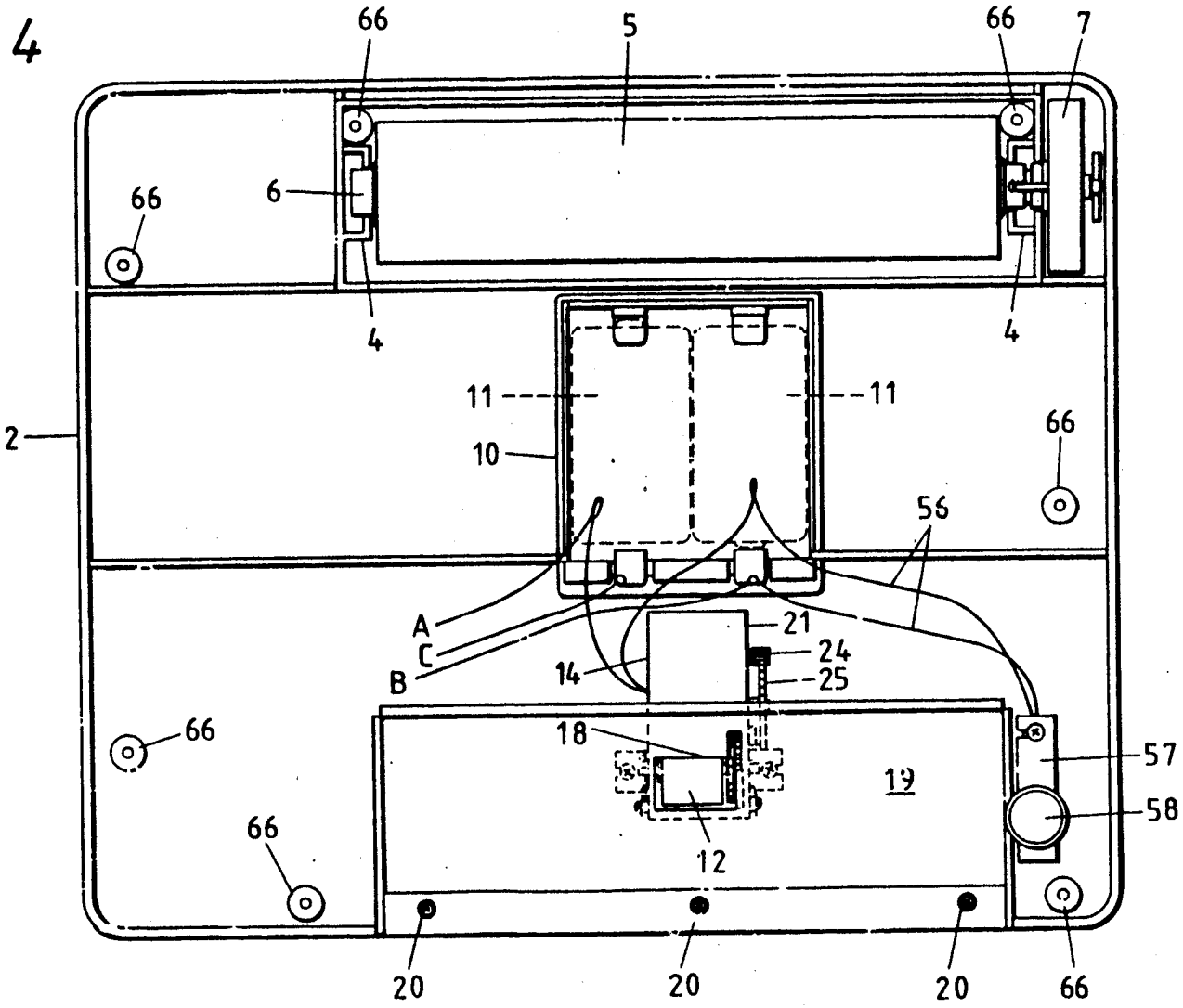
FIG. 4 is a plan view for illustrating a construction inside a case main body.

The preferred embodiment of the present device will be described hereunder on the basis of the drawings. Numeral 1 denotes a hollow, molded plastic case imitating the external appearance of a facsimile apparatus and it comprises a case main body 2 and a case cover body 3. In the rear part inside the case main body 2 a pair of bearings 4, 4 FIG. 4 spaced apart right and left are provided, and a take-up shaft 6 upon which long recording paper 5 is rolled is positioned rotatably and removably on these bearings 4, 4, while a spool 7 for rotating the take-up shaft 6 manually is joined removably to one end of this take-up shaft 6. As shown in FIGS. 3 and 4, inside the case main body 2, a battery box 10 having an opening 9 opened or closed by a cover plate 8 is provided in the base of the case main body 2, and in this battery box 10, two dry batteries 11, 11 are housed so that like poles thereof are located on the opposite sides. In the front part inside the case main body 2, a paper transfer mechanism 14 equipped with transfer rolls 12, 13 which hold, from above and below, the leading end of recording paper 5 so drawn out from the take-up shaft 6 as to be inclined slightly downward is provided, and on the upper side of the low front end wall 15 of the case main body 2, a delivery port 16 for delivering outside the case 1 the recording paper 5 transferred by the paper transfer mechanism 14 is provided. In a space between the take-up shaft 6 and the paper transfer mechanism 14 and on the upper side of the case main body 2, a ground plate 17 is inclined gently so that it is in contact with the lower side of the recording paper 5 transferred by the paper transfer mechanism 14 while a guide plate 19 which is in contact with the lower side of the recording paper 5 and so inclined steeply as to guide the recording paper 5 to the delivery port 16 and which has an opening 18 formed therein so that part of the recording paper 5 held between the transfer rolls 12, 13 may not be blocked up, is disposed in a part extending from the front end of said ground plate 17 to the delivery port 16, and the front edge thereof is fixed to the case main body 2 by screws 20.

Figure 6:
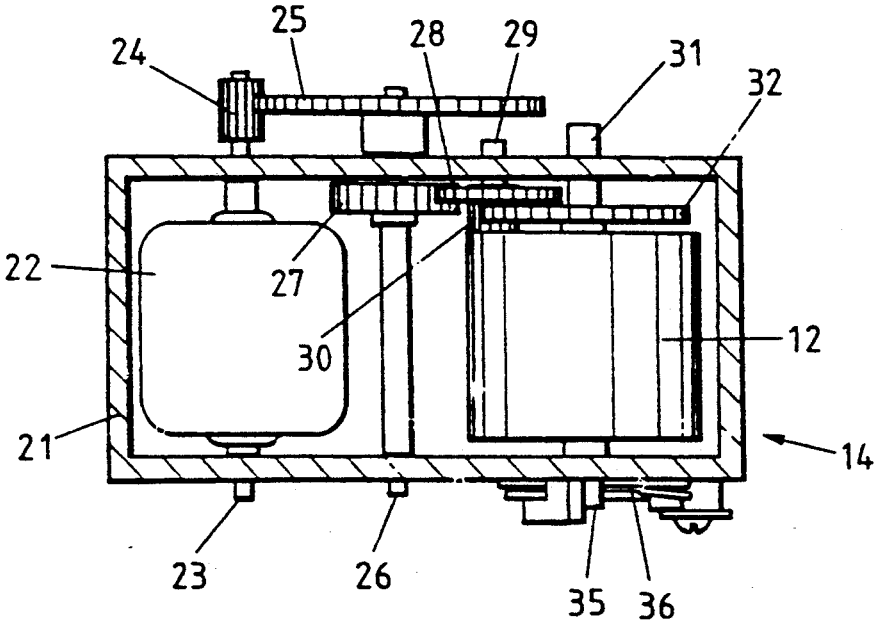
FIG. 6 is a plan view for illustrating the construction of a paper transfer mechanism.

The construction of the above-mentioned paper transfer mechanism 14 is such that a small-sized motor 22 and a transfer roll 12 made up of a rubber roll and laid axially so that it rotates in frictional contact with the lower side of and in the direction of transfer of the recording paper 5 are provided inside a mechanism frame 21 (FIG. 6), for instance, a pinion gear 24 is fixed to that end of a rotating shaft 23 of the small-sized motor 22, which projects outside the mechanism frame 21, a pinion gear 27 is fixed to the part inserted into the mechanism frame 21, of a shaft 26 so laid in the mechanism frame 21 as to support axially a gear 25 engaging with said pinion gear 24, and a pinion gear 30 is fixed to a shaft 29 so laid in the mechanism frame 21 as to support axially a gear 28 engaging with said pinion gear 27, while a gear 32 fixed to a support shaft 31 of the transfer roll 12 is made to engage with said pinion gear 30. The rotation of the motor 22 is transmitted to the transfer roll 12 by this group of gears, the speed of the rotation being reduced thereby, and the transfer roll 13 made up of a plastic roll, which rotates in contact with the upper side of the recording paper 5 with the rotation of the transfer roll 12, is positioned axially above the transfer roll 12.

Figure 7:
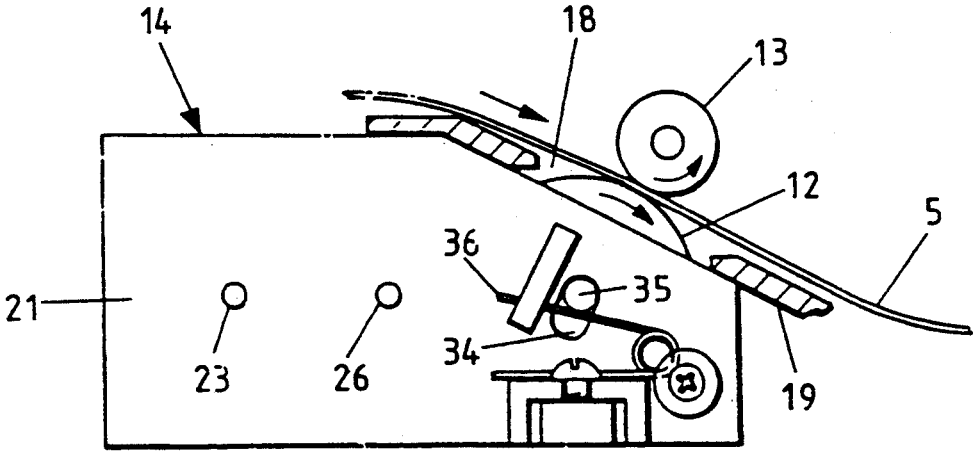
FIG. 7 is a side view for illustrating the construction of the paper transfer mechanism.

In this paper transfer mechanism 14, the support shaft 31 of the transfer roll 12 is inserted through long holes 33 and 34 (FIG. 7) bored in the opposite side walls of the mechanism frame 21, while a spring 36 actuating the support shaft 31 so that this shaft pushes up the transfer roll 12 to a position where it is always in contact with the transfer roll 13 and simultaneously pushes down the gear 32 to a position whereat it is always in contact with the pinion gear 30, is provided for suspension at one end 35 of the support shaft 31.

Figure 1:
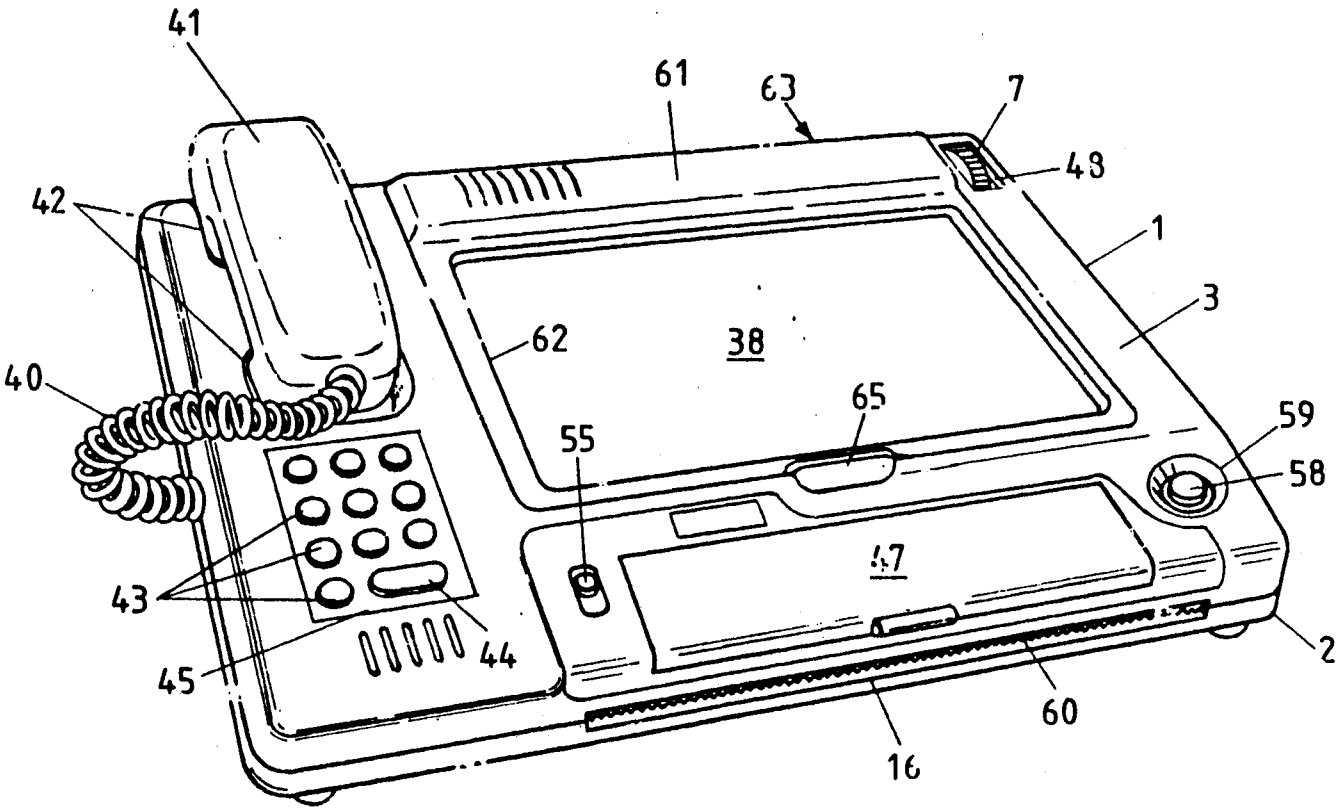
FIG. 1 is a perspective view of an external appearance.
Figure 2:
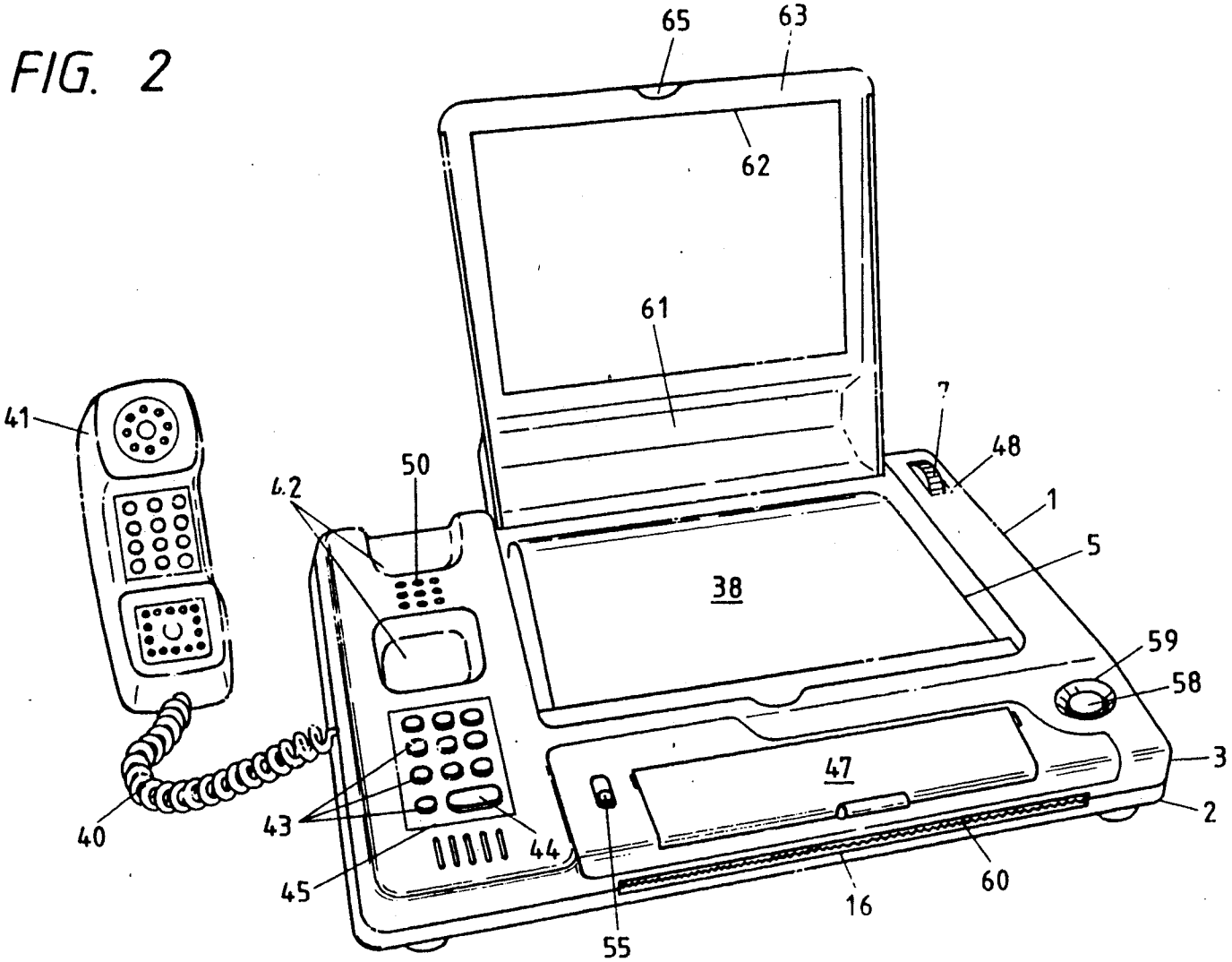
FIG. 2 is a perspective view showing a state wherein a model handset is removed and a cover is opened.
Figure 5:
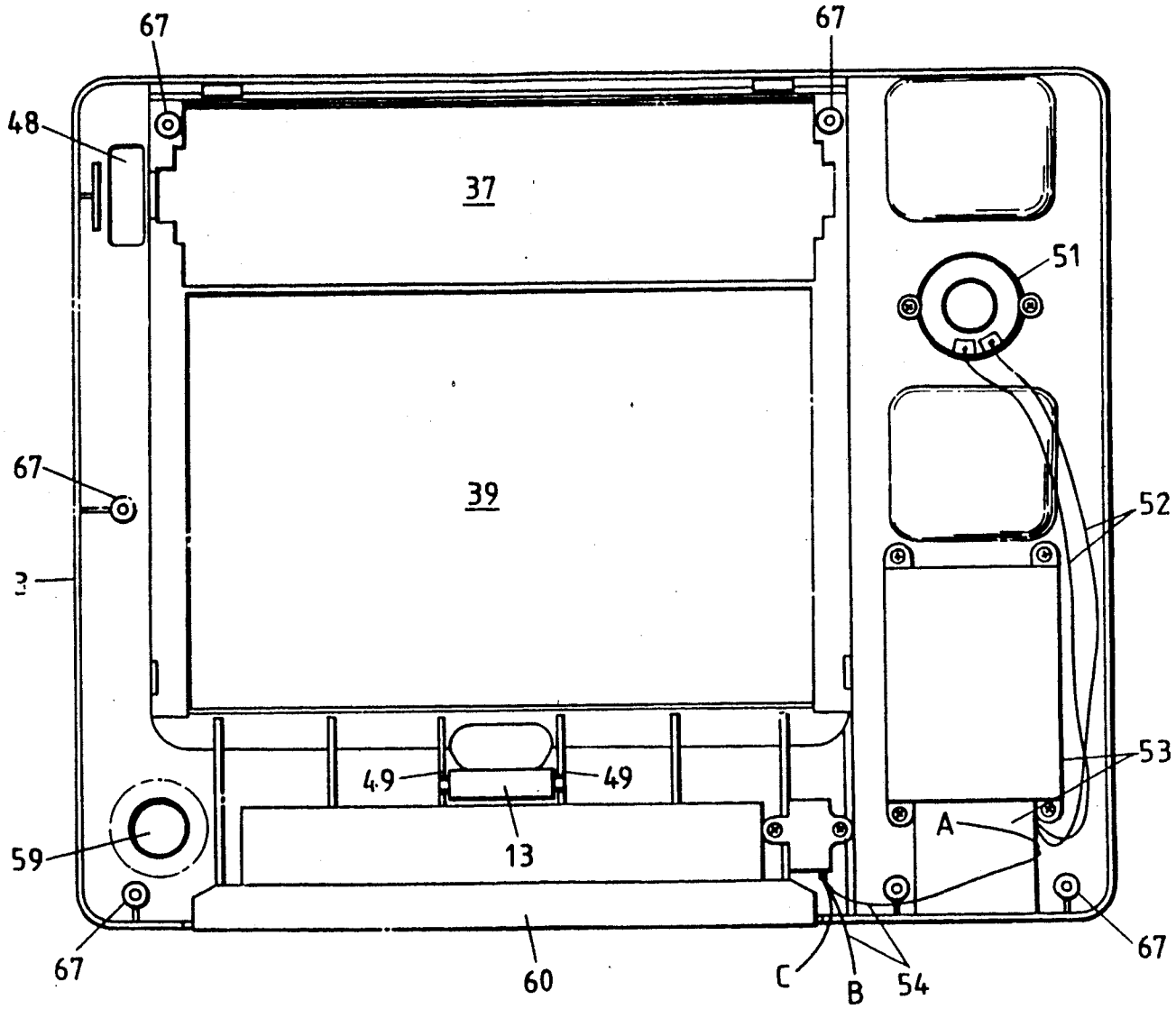
FIG. 5 is a bottom plan view for illustrating a construction inside a case cover body.

In the case cover body 3, an opening 37 (FIG. 5) through which the take-up shaft 6 of the recording paper 5 is carried in or out, a cut opening 39 cut in accordance with the dimension of the width of a surface 38 (FIG. 2) of the recording paper 5 transferred onto the ground plate 17 (FIG. 3), a handset seat 42 (FIGS. 1 and 2) whereon a model handset 41 connected to the lateral side of the case main body 2 by a helical cord 40 is placed, an operation panel unit 45 which supports a push button group 43 comprising ten push buttons representing numerals 0 to 9 in imitation of push buttons of a push-button telephone set and a separate push button 44, an accommodation chamber 46 (FIG. 3) for accommodating writing materials and the like, a cover 47 for this accomodation chamber 46, and a cut hole 48 so cut as to make a part of the outer circumference of the spool 7 project, are provided. Inside the case cover body 3, bearings 49 (FIG. 5) bearing the transfer roll 13 rotatably, a small-sized speaker 51 so disposed as to be opposite to a small-hole group 50 (FIG. 2) bored in the handset seat 42, an IC circuit 53 (FIG. 5) which is so disposed as to be opposite to the operation panel unit 45 and is connected to the small-sized speaker 51 by lead wires 52 and which stores tones of the musical scale of do, re, mi, and others and a sound similar to that of a telephone ring and transmits a signal of each of said tones to the small-sized speaker 51 in response to the operation of each push button of the push button group 43 and of the push button 44, a power switch 55 (FIGS. 1 and 2) connected between said IC circuit 53 and the dry batteries 11, 11 by lead wires 54, and a cut hole 59 (FIGS. 1 and 2) which is cut so that a push button 58 for operating a motor switch 57 (FIG. 4) connected between the dry batteries 11, 11 and the small-sized motor 22 by lead wires 56 inside the case main body 2 is made to project therethrough, are provided, and a saw-toothed edge 60 (FIGS. 1–3) for cutting off the recording paper 5 is fixed to that part of the front end of the case cover body 3, which faces the exit of the delivery port 16.

The case cover body 3 is put on the case main body 2 and fixed integrally to the case main body 2 by driving screws through several joining holes 66 (FIG. 4) provided in the case main body 2 into corresponding joining holes 67 (FIG. 5) provided in the case cover body 3.

A cover 63 (FIGS. 1–3) having a cover part 61 with which the opening 38 is covered and a window frame part 62 surrounding the surface 38 of the recording paper 5 to expose a prescribed area thereof on the cut opening 39 (FIG. 5) is put on the case cover body 3, and a pivotally-fitted part 64 (FIG. 3) fitted pivotally to the rear end of the case cover body 3 so that the cover can be opened and closed is provided at the rear end of said cover 63, while a grip part 65 (FIGS. 1 and 2) is provided at the front end of the cover 63.

Next, one example of the operation of the toy facsimile having the above construction will be described. First the power switch 55 is turned ON and a character, a picture or the like is written or drawn on the surface 38 of the recording paper 5 exposed within the window frame part 62 of the cover 63. When the writing or drawing is finished, the copy thus prepared is handled as if it were set in the facsimile apparatus as an original copy to be transmitted, and the push buttons of the push button group 43 are pushed in imitation of an operation of calling up the facsimile number of the person to whom the transmission is made, or the push button group 43 is operated, with the model handset 41 picked up from the handset seat 42 and held to the ear, in imitation of making a telephone call. When a push button of the push button group 43 representing a numeral "1" is pushed during the above-stated operation, a signal of a tone "do" out of the seven-tone musical scale of do, re, mi and others stored in the IC circuit 53 is transmitted to the speaker 51 and the tone "do" is emitted from the speaker 51. When a push button representing a numeral "2" is pushed, a signal of a tone "re" out of said scale is transmitted to the speaker 51 and the tone "re" is emitted from the speaker 51. In this way, ten kinds of tones comprising seven tone of "do" to "ti" and subsequent three tones of "do" to "mi" one octave higher than the preceding ones are emitted from the speaker 51 when the push buttons up to the one representing a numeral "0" are pushed sequentially. When the push button 44 is pushed, a signal of a sound similar to that of a bell of a telephone, which is stored in the IC circuit 53, is transmitted to the speaker 51 and the sound similar to that of the bell of the telephone is emitted from the speaker 51. When the motor switch 57 is operated to be ON after the above-described operations of the push buttons are completed, the motor 22 is electrified to rotate. The rotation thereof is transmitted to the transfer rolls 12 and 13 via the group of gears of the paper transfer mechanism 14 and thereby the transfer rolls 12 and 13 are so rotated as to deliver the recording paper 5 outside the case 1 via the delivery port 16. When the aforesaid original copy to be transmitted is sent out, the rotation of the motor 22 is stopped by operating the motor switch 57 to be OFF, and said original copy is cut off by the edge 60. Then, the power switch 55 is turned OFF and thus a series of operations imitating the operation of a facsimile apparatus is completed.

When the recording paper is used up in full length by repeating the operations described above, the cover 63 is opened, the spool 7 is removed from the end of the take-up shaft 6, the take-up shaft 6 is taken out, fresh recording paper 5 is rolled round thereon or the shaft is replaced by another take-up shaft 6 whereon fresh recording paper 5 has already been rolled, and thereafter the take-up shaft is laid between the bearings 4, 4 as before. After the laying is finished, the fore end of the recording paper 5 is pull out, passed between the transfer rolls 12 and 13 and then inserted into the delivery port 16. If the recording paper 5 is found slackening, the take-up shaft 6 is rotated in the direction of taking up the recording paper 5 by the spool 7, so as to correct the slack. After these operations are completed, the cover 63 is closed to be ready for reuse.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

I claim:

1. A toy facsimile machine, comprising:

a hollow case having the external appearance of an operable facsimile machine;

a take-up shaft rotatably mounted within said hollow case;

said take-up shaft adapted to support an elongate sheet of recording paper disposed in rolled relation thereabout;

a pair of rotatably-mounted transfer roll members, also positioned within said hollow case, for frictionally engaging a leading end of said recording paper so that rotation of said transfer roll members causes said recording paper to unroll from said take-up shaft, a first transfer roll member contacting a lower side of said recording paper and a second transfer roll member contacting an upper side thereof;

said take-up shaft being positioned in a rearward part of said hollow case and said transfer roll members being positioned in a forward part thereof;

a delivery port formed in said hollow case in said forward part thereof, said delivery port having a size sufficient for said recording paper to pass through when said transfer roll members are rotated so that said recording paper is delivered to the environment external to said hollow case when said transfer roll members are rotated;

a cutting means disposed adjacent said delivery port for cutting said recording paper;

a window frame means formed in said case to expose a predetermined area of said recording paper to an individual playing with said toy;

a handset seat formed in said case;

a model handset selectively positionable in said handset seat;

a group of push buttons positioned on an upper surface of said hollow case so that said individual playing with said toy may manipulate said push buttons;

a motor means for effecting rotation of said transfer rolls;

a speaker means positioned in close proximity to said handset seat;

an integrated circuit connotatively coupled to said speaker means;

said integrated circuit adapted to generate a plurality of distinct tones in response to manipulation of said push buttons, there being a different tone associated with each of said push buttons;

a battery means for supplying power to said motor means, said integrated circuit, and said speaker means; and a plurality of switch means for activating said motor means, said integrated circuit, and said speaker means.

2. The toy of claim 1, further comprising a flat ground plate disposed between said take-up shaft and said transfer roll members, said ground plate being positioned under said recording paper when said recording paper is unrolled from said take-up shaft, said ground plate thereby providing support for said recording paper so that a user of said toy may write and draw upon said recording paper.

3. The toy of claim 2, wherein said ground plate is inclined slightly downwardly from said rearward end of said toy toward said forward end thereof.

4. The toy of claim 2, wherein said case includes a case main body that provides a base for said toy and a case cover body that is positioned atop said base and which cooperates with said base to define the hollow interior of said toy.

5. The toy of claim 2, further comprising a guide plate disposed in spaced apart relation relative to said ground plate such that said transfer roll members are disposed between said ground plate and said guide plate and wherein said transfer roll members serve to transfer said recording paper from supported relation to said ground plate to supported relation to said guide plate.

6. The toy of claim 2, wherein said guide plate is inclined downwardly more steeply than said ground plate in said rearward to forward direction, and wherein said guide plate is fixedly secured to said case main body.

7. The toy of claim 4, further comprising a hand-rotatable spool fixedly secured to a preselected end of said take-up shaft so that rotation of said spool in a predetermined direction effects conjoint rotation of said take-up shaft and is therefore effective to take up slack in said recording paper, said case cover body having an opening formed therein to accommodate a predetermined circumferential extent of said spool so that said spool and hence said take-up shaft may be rotated without removing said case cover body from said case main body.

8. The toy of claim 4, further comprising a take-up shaft opening formed in said case cover body through which said take-up shaft and recording paper rolled thereabout may be introduced into or removed from said toy without removing said case cover body from said case main body.

9. The toy of claim 4, further comprising an opening formed in said case cover body that has a predetermined width and length so that a user of said toy may write directly on said recording paper through said opening without removing said case cover body from said case main body.

10. The toy of claim 4, further comprising a cover means that is pivotally mounted to said case cover body, a window frame opening being formed in said cover means, said window frame opening framing said exposed part of said recording paper when said cover means is closed, and said cover means including an imperforate part that closes said take-up shaft opening when said cover means is closed.

11. The toy of claim 1, further comprising an accommodation chamber for holding miscellaneous items and a lid for selectively opening and closing said chamber, said chamber being formed near a front end of said toy.

12. The toy of claim 1, further comprising a cord for interconnecting said model headset and said hollow case.

13. A toy facsimile machine, comprising:

a hollow case for housing a rotatably mounted roll of paper;

a pair of rotatably mounted transfer roll members that frictionally engage the paper to unroll it;

a flat ground plate positioned between the roll of paper and the transfer roll members to support the unrolled paper so that the user of the toy may write and draw on the paper;

a motor for activating the transfer roll members;

an integrated circuit for generating tone signals;

a speaker for converting those signals into sound;

a battery means for operating the motor and integrated circuit;

a window frame formed in the case to expose the paper so that the user may write and draw on it;

a delivery port formed in a leading end of the toy so that operation of the transfer roll members feeds the paper out of the hollow interior of the toy through said port;

a cutting device positioned at the port so that the discharge paper may be cut off by pulling up on it;

a model telephone head set cradled by the case; and a plurality of push buttons electrically connected to said integrated circuit;

whereby a user of the toy may write and draw on the paper in registration with the window frame, may lift the model headset from the case, may punch the push buttons to generate distinct tones, may hear said tones played through the speaker, may activate the motor to cause unrolling of the paper, and may tear off a part of the paper having drawing and writing thereon after said part has been discharged from the toy through said delivery port.

14. The toy of claim 13, further comprising:

a guide plate that guides the paper to the delivery port;

said guide plate being spaced apart from said ground plate; and said transfer roll members being positioned between said ground plate and said guide plate so that rotation of said transfer roll members feeds the paper from the ground plate to the guide plate.

15. The toy of claim 14, further comprising a manually operated rotatably mounted spool for taking slack out of the roll or paper.

* * * * *